US008727168B2

(12) United States Patent
Bitton

(10) Patent No.: US 8,727,168 B2
(45) **Date of Patent: *May 20, 2014**

(54) PRODUCT CONTAINER STRAINER

(71) Applicant: Eddy Bitton, Westlake Village, CA (US)

(72) Inventor: Eddy Bitton, Westlake Village, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/796,970

(22) Filed: Mar. 12, 2013

(65) Prior Publication Data

US 2013/0196042 A1 Aug. 1, 2013

Related U.S. Application Data

(63) Continuation of application No. 12/137,404, filed on Jun. 11, 2008, now Pat. No. 8,393,490.

(60) Provisional application No. 60/934,204, filed on Jun. 11, 2007.

(51) Int. Cl.
*B65D 17/34* (2006.01)

(52) U.S. Cl.
USPC ..... 220/271

(58) Field of Classification Search
USPC ..... 220/269, 271, 361, 370, 371, 372; 222/189.06, 189.09, 189.07, 189.11; 210/466, 464, 468, 469
See application file for complete search history.

(56) References Cited

U.S. PATENT DOCUMENTS 8,393,490 B2 * 3/2013 Bitton ..... 220/271

* cited by examiner

*Primary Examiner* — Jeffrey Allen
(74) *Attorney, Agent, or Firm* — K. David Crockett, Esq.; Paul J. Backofen, Esq.; Crockett & Crockett, PC

(57) ABSTRACT

A single use packing and dispensing technique includes a filter element as part of the packaging to permit a user to drain the packing fluid while retaining the primary package contents such as pickles, olives, canned vegetables, fruit, canned meats, poultry and fish. A strainer may be incorporated into any suitable aspect of the packaging along with a removable sealing element.

4 Claims, 1 Drawing Sheet

PRODUCT CONTAINER STRAINER

RELATED APPLICATIONS

This application is a continuation of U.S. Utility patent application Ser. No. 12/137,404 filed Jun. 11, 2008, now U.S. Pat. No. 8,393,490, which claims priority from U.S. provisional patent application 60/934,204 filed Jun. 11, 2007.

FIELD OF THE INVENTIONS

The inventions described below relate the field of consumer product packaging and more specifically to food packaging for products stored in liquid.

BACKGROUND OF THE INVENTIONS

Many people who prepare or serve food have experienced the difficulty of opening a container of food that contains liquid packaging such as pickles, olives, canned vegetables, canned meats, poultry and fish and faced the challenge of draining the liquid.

SUMMARY

A packing and dispensing technique according to the present disclosure includes a filter element as part of the packaging to permit a user to drain the packing fluid while retaining the primary package contents. The strainer element is incorporated into any suitable surface of the packaging and is sealed during processing. Opening or breaking the strainer seal permits the packing fluid to be removed and the primary package contents to be retained in the container.

DETAILED DESCRIPTION OF THE INVENTIONS

Figure 1:
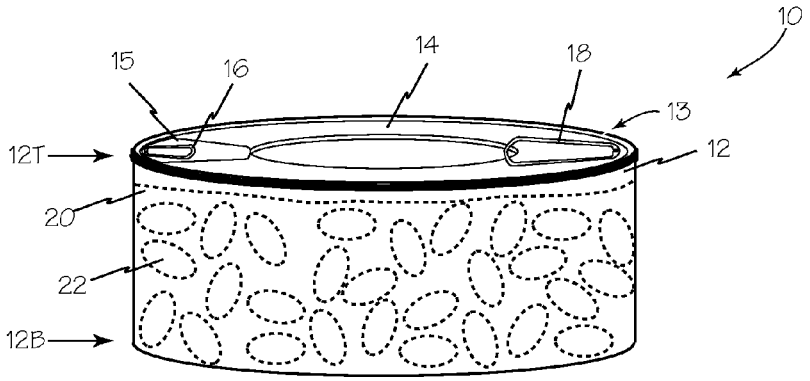
FIG. 1 is a perspective view of a product container including a strainer end.
Figure 2:
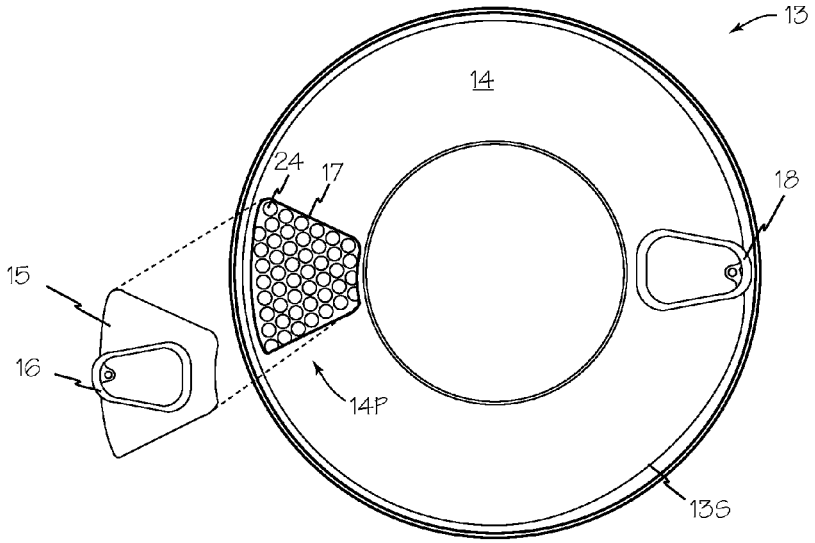
FIG. 2 is a top view of a product strainer end and sealing element.

Single use product container 10 of FIG. 1 is formed using container body 12 and strainer end 13. Container body 12 is generally cylindrical with a sealed end 12B and an open end 12T fitted with strainer end 13. Strainer end 13 is shaped and sized similar to conventional can ends which are generally roll-crimped or otherwise sealed to the can body. Strainer end 13 also includes strainer 17 occupying portion 14P of removable top 14. With strainer sealing element 15 in place on end 13, primary contents 22, such as pickles, olives or other contents and packing fluid 20, may be secured, sealed and heat sterilized within product container 10 using any suitable technique. Strainer end 13 includes a pull ring or tab 18 for removing top 14 and strainer section 17 as shown in FIG. 2. Strainer section 17 may occupy any suitable portion such as portion 14P of the removable lid and may include a suitable number of openings such as opening 24 which may adopt any suitable shape such as, but not limited to, round, polygonal, ovoid, or complex. Strainer section 17 is sealed for distribution using any suitable sealing element 15 that may have a tab or other suitable mechanism such as tab 16 for removal of the sealing element such as sealing element 15.

In operation a user may grasp strainer tab 16 and pull to remove sealing element 15. Product container 10 may then be oriented to permit packing liquid 20 to empty through strainer 17. Upon completion of the straining of product container 10, a user may grasp pull tab 18 and lift and pull to remove top 14 from container body 12 along seal 13S permitting access to primary contents 22. To expedite the draining process, pull tab 18 may be used to break the seal along scored edge 13S and provide a vent for introduction of air into the container and allow the packing liquid to drain faster.

Figure 3:
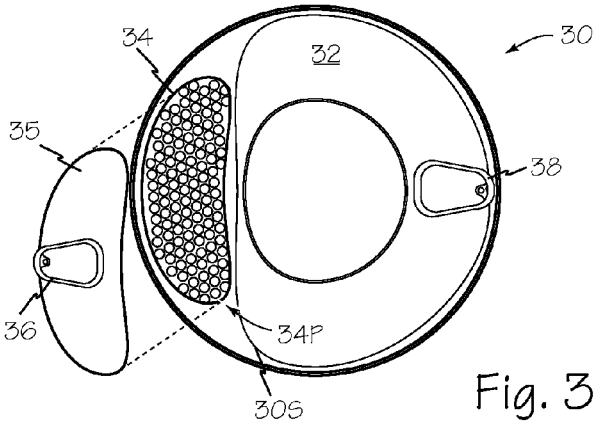
FIG. 3 is a top view of an alternate product strainer end and sealing element.

Alternate strainer end 30 of FIG. 3, includes strainer 34 separate from removable top 32. Strainer 34 is sealed during manufacturing, shipping, and storage by sealing element 35. Pull tab 36 is secured to sealing element 35 and is used to unseal the sealing element and remove the sealing element. Pull tab 38 is used to break the primary seal along score 30S and remove pull top 32.

Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

I claim:

1. A container comprising:

a container body having a sealed end and an open end;

a strainer end secured to the container body sealing the open end of the container body, the strainer end including a pull top defined by a scored edge to enable removal of the pull top, the pull top including a strainer formed by an plurality of openings in the pull top;

a sealing element, sealing the strainer;

a first pull tab secured to the sealing element for removing the sealing element from the strainer; and a second pull tab secured to the pull top for removing the pull top.

2. A method of straining liquid from a container having food packed in liquid, the method comprising the steps:

providing the container as in claim 1, the container containing food packed in liquid;

pulling a first pull tab to remove the sealing element over the strainer; and orienting the container to permit the liquid to exit the container through the strainer.

3. The method of claim 2, after the orienting step, further comprising the step:

pulling the second pull tab secured to the pull top for breaking the seal of the sealed container body to permit the introduction of air into the container as the packing fluid drains.

4. A container for food packed in liquid, the container comprising:

a container body;

a strainer end secured to the container body sealing an open end of the container body, the strainer end including a pull top defined by a scored edge to enable removal of the pull top, the pull top including a first pull tab for removing the pull top and a strainer formed by an array of openings in the pull top, the array of openings sized to permit passage by the fluid and retain the food in the container body;

a sealing element, sealing the strainer; and a second pull tab secured to the sealing element for removing the sealing element from the strainer.

* * * * *